US008696480B2

(12) United States Patent
Sasser

(10) Patent No.: US 8,696,480 B2
(45) Date of Patent: Apr. 15, 2014

(54) GOLF SWING TRAINING APPARATUS

(76) Inventor: Quentin Sasser, Salt Lake City, UT (US)

( * ) Notice: Subject to any disclaimer, the term of this patent is extended or adjusted under 35 U.S.C. 154(b) by 0 days.

(21) Appl. No.: 13/252,140

(22) Filed: Oct. 3, 2011

(65) Prior Publication Data

US 2012/0264533 A1 Oct. 18, 2012

Related U.S. Application Data

(60) Provisional application No. 61/388,678, filed on Oct. 1, 2010.

(51) Int. Cl.
*A63B 69/36* (2006.01)

(52) U.S. Cl.
USPC ..... 473/208; 473/257; 473/277

(58) Field of Classification Search
USPC ..... 473/207, 215, 216, 218, 219, 257, 473/261–266, 270, 271, 273, 275, 277
See application file for complete search history.

(56) References Cited

U.S. PATENT DOCUMENTS

| | | | | |
|---|---|---|---|---|
| 6,322,456 | B1 * | 11/2001 | Benggon | 473/219 |
| 6,575,844 | B1 * | 6/2003 | Gray | 473/277 |
| 6,843,730 | B1 * | 1/2005 | Bellagamba | 473/216 |
| 6,939,242 | B1 * | 9/2005 | Battersby | 473/219 |
| 7,431,661 | B1 * | 10/2008 | Cailey | 473/257 |
| 2010/0311515 | A1 * | 12/2010 | Hennessey | 473/257 |

* cited by examiner

*Primary Examiner* — Nini Legesse
(74) *Attorney, Agent, or Firm* — Steven Rinehart

(57) ABSTRACT

The present invention discloses a golf swing trainer for improving a golfer's drive, posture, and technique when swing a golf club. The golf swing trainer includes a base, two lateral arms, and inside and outside guides which form a corridor through which a golf club is swung. Other elongated members are disclosed for securing a golfer's waste with a harness, bracing their leg, and the like. These components allow a golfer to simulate a golf swing and practice posture and technique preparatory to driving an actual golf ball.

6 Claims, 4 Drawing Sheets

GOLF SWING TRAINING APPARATUS

CROSS-REFERENCES TO RELATED APPLICATION

This application claims priority to U.S. Provisional Patent Application No. 61/388,678 entitled "Golf Swing Training Apparatus," filed Oct. 1, 2010 for Quentin Lewis Asser, which is incorporated herein by reference.

BACKGROUND OF THE INVENTION

1. Field of the Invention

This invention relates to golf products, and more particularly relates to an apparatus for training a golfer to improve a golf swing.

2. Description of the Related Art

The prior art includes a variety of golf training devices for improving a golfer's swing of a golf club. The purpose of these devices is to impart more control over the club and ball trajectory to a golfer. The ability to control and properly swing a club are essential to achieve the distance and trajectory of a golf ball necessary to play well. This is true whether driving, putting, chipping, pitching, etc. Good golfers can control the angle of the club face at impact, the speed of the club at impact, and the distance off center of the club with the ball. These techniques can be improved with practice, but not well without coaching. The prior art does not teach means for controlling body posture, and club trajectory simultaneously.

Many of the golf training devices known in the art are cumbersome and inefficient. There is a need for a golf swing training apparatus which overcomes these problems with the devices taught by the prior art.

SUMMARY OF THE INVENTION

From the foregoing discussion, it should be apparent that a need exists for a golf swing training apparatus. Beneficially, such a device would overcome many of the difficulties with prior art by providing a more functional apparatus to consumers and professionals for improving body posture and club trajectory.

The present invention has been developed in response to the present state of the art, and in particular, in response to the problems and needs in the art that have not yet been fully solved by currently available apparatii and methods. Accordingly, the present invention has been developed to provide a golf swing training device comprising: a base comprising a plurality of tubular components, the base for engaging a ground surface, the base comprising a lower surface for engaging a ground surface and an opposing upper surface, the base defining an area on the ground upon which a golfer should stand when using the training device; a left lateral arm affixed to the base, the left lateral arm extending from the base; a right lateral arm affixed to the base, the right lateral arm extending from the base; a first inner guide affixed to the left lateral arm and extending upwards above the upper surface of the base; a first outer guide affixed to the left lateral arm and extending upwards above the upper surface of the base; and a second inner guide affixed to the right lateral arm and extending upwards above the upper surface of the base.

The golf swing training device further comprises a second outer guide affixed to the right lateral arm and extending upwards above the upper surface of the base; wherein the first inner guide is in closer proximity to a center of the base than the first outer guide; wherein the second inner guide is in closer proximity to a center of the base than the second outer guide; wherein a region between the first inner guide and the first outer guide defines a point on a linear corridor passing through a second point defined by a region between the second inner guide and the second outer guide, the corridor defining the acceptable path of a golf club being swung under simulated golf conditions.

The golf swing training device may further comprise a tubular shaft affixed to the base, the shaft extending upward orthogonally from the base, the shaft affixed to a harness for securing the mid-section of a golfer's body.

The golf swing training device may further comprise a leg brace jutting orthogonally from the shaft for securing the left a golfer's body.

The golf swing training device may further comprise a tubular shaft affixed to the base, the shaft extending upward orthogonally from the base, the shaft affixed to a bracket, the bracket affixed to a harness for securing the mid-section of a golfer's body.

The left lateral arm and the right lateral arm may comprise telescoping components such that length of the left lateral arm and the length of the right lateral arm can be independently adjusted.

The base may further comprise a tee for securing a golf ball.

A second golf swing training device is disclosed comprising: a planar base for engaging a ground surface, the base comprising a planar lower surface and an opposing planar upper surface, the base defining an area above the ground upon which a golfer should stand when using the training device; an inner guide affixed to the base and extending upwards above the upper surface of the base; an outer guide affixed to the base and extending upwards above the upper surface of the base; wherein the inner guide is in closer proximity to a center of the base than the outer guide; wherein the inner guide and the outer guide define a region for swing a golf club.

The golf swing training apparatus of claim 8, further comprising a tubular shaft affixed to the base, the shaft extending upward orthogonally from the base, the shaft affixed to a harness for securing the mid-section of a golfer's body.

The golf swing training apparatus may further comprise a leg brace jutting orthogonally from the shaft for securing the left a golfer's body. The golf swing training apparatus may further comprise a head brace affixed to the shaft for immobilizing a golfer's head.

The golf swing training apparatus may also comprise a plurality of braces for securing extremities of a golfer's body. The inner guide and outer guide may be wrapped in one of silicone gel and polyurethane.

These features and advantages of the present invention will become more fully apparent from the following description and appended claims, or may be learned by the practice of the invention as set forth hereinafter.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention may be practiced without one or more of the specific details, or with other methods, components, materials, and so forth. In other instances, well-known structures, materials, or operations are not shown or described in detail to avoid obscuring aspects of the invention.

Figure 1:
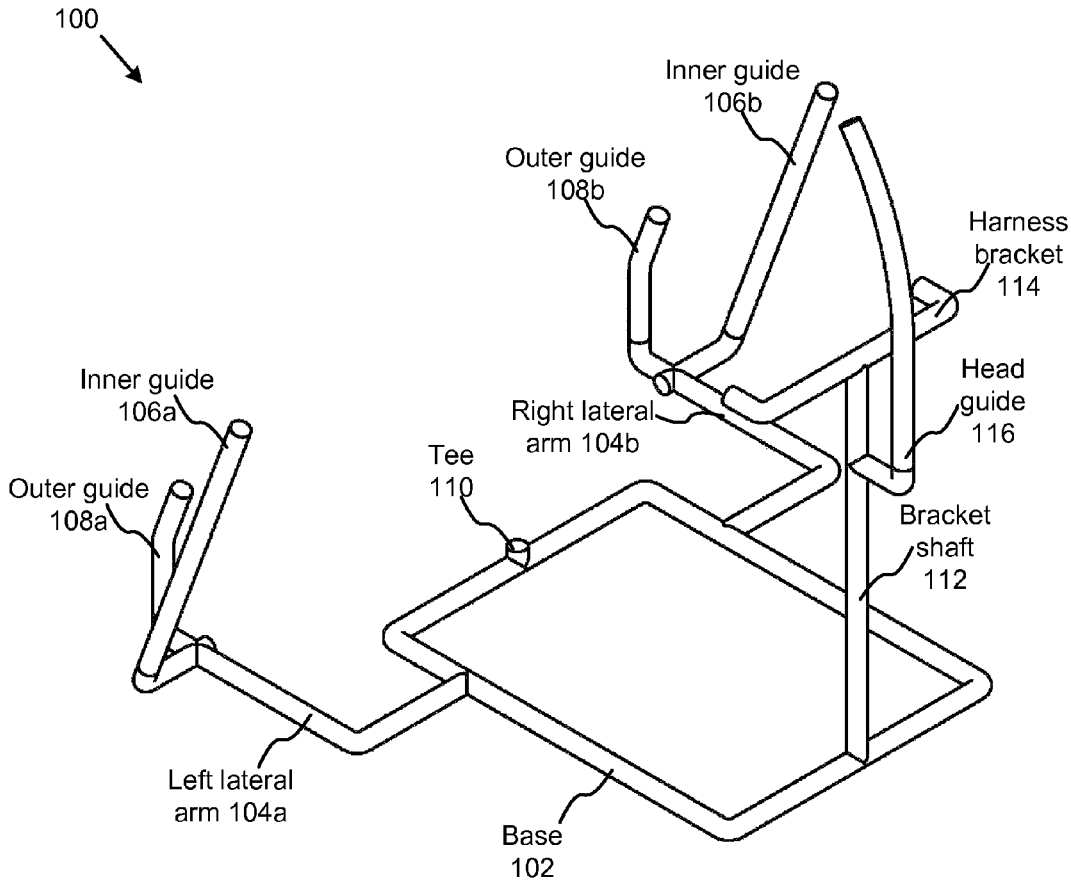
FIG. 1 is a side elevational perspective view of a golf swing training apparatus in accordance with the present invention.

FIG. 1 is a side elevational perspective view of a golf swing training apparatus 100 in accordance with the present invention. The golf swing training apparatus 100 (i.e. golf trainer) comprises a base 102, a left lateral arm 104*a*, a right lateral arm 104*b*, an inner guide 106*a*, an inner guide 106*b*, an outer guide 108*a*, an outer guide 108*b*, a tee 110, a bracket shaft 112, a harness bracket 114, and a head guide 116.

The base 102 is fabricated, in the shown embodiment, from one a rigid polymer, metal, carbon, alloy, wood, glass, elastomeric, or silastic material. The base 102 in the shown embodiment is rectangular, but also be circular, square, polygonal, etc.

The base 102 may be fabricated from tubular members as shown, in which variation the base 102 comprises left and right sides, and forward and rearward members. The base 102 may be formed from PVC pipe, polymer tubing, metal tubing, bars, pipes, shafts, and the like. The base 102 may comprise wood, polymers, metal, alloys, silastic material, composites, and the like.

In some embodiments, the base comprises a planar component for stabilizing the golf trainer 100 made of metal, polymers and/or wood, such as a board or sheet metal.

The left lateral arm and right lateral arm jut from the sides of the base 102 along a ground surface in the shown embodiment. In other embodiments, the lateral arms 104*a-b* may incline up away from the ground surface.

The lateral arms 104*a-b* are each affixed to a pair of guides, an inner guide and an outer guide. The inner guides 106*a-b* extend upwards (in some cases orthogonally) away from the lateral arms to which each guide 106*a-b* is respectively affixed. Each inner guide 106 is in closer proximity to the point at which the lateral arm 104 is affixed to the base 102 than a corresponding outer guide 108 is in distance from the same point. Thus, the inner guide 106*a* is closer to the point at which the left lateral arm 104*a* is affixed to the base 102 than is the outer guide 108*a*. The same is true of the inner guide 106*b* with respect to the outer guide 108*b*.

In some embodiments, the golf trainer 100 comprises only a single lateral arm to which the inner guides 106*a-b* and/or the outer guides 108*a-b* are connected. Likewise, the golf trainer 100 may also comprise only one set of guides (e.g. only one inner guide 106 and one outer guide 108). These guides 106-108 may be tubular or may be planar in shape and extending across their planar face from four inches to six feet.

The inner guides 106*a-b* and the outer guides 108*a-b* need not be straight or perfectly cylindrical. Like the base 102, they may comprise tubular members which are bent, curved, or angled to allow a golfer standing on, or within, the base 102 to swing a golf club between the inner guide 106*a* and the outer guide 108*a*.

The inner guides 106*a-b* and the outer guides 108*a-b* may be wrapped in plastic, silicone gel, polyurethane, memory foam, or other types of padding for protecting the guides 106-108 from the impact of misguided golf club passing between them.

The golf trainer 100 may also comprise a bracket shaft 112 which juts upward from the base 102. In the shown embodiment, the bracket shaft 112 comprises a tubular member made from aluminum, steel, or polymers. The bracket shaft 112 is affixed to a harness bracket 114 which is affixed to a harness for securing the waste or mid-section of a golfer. In some embodiments, the harness immobilizes the waste of the golfer. In other embodiments, the harness allows only limited movement on the part of the golfer.

The bracket shaft 112 may be affixed to a head guide 116, which is a tubular member for securing a golfer's head. In some embodiments, the head guide 116 comprises a brace or bracket for stabilizing the head of a golfer during a simulated swing.

The tee 110 comprises means for securing a golf ball before being hit, and is well-known to those of skill in the art.

Figure 2:
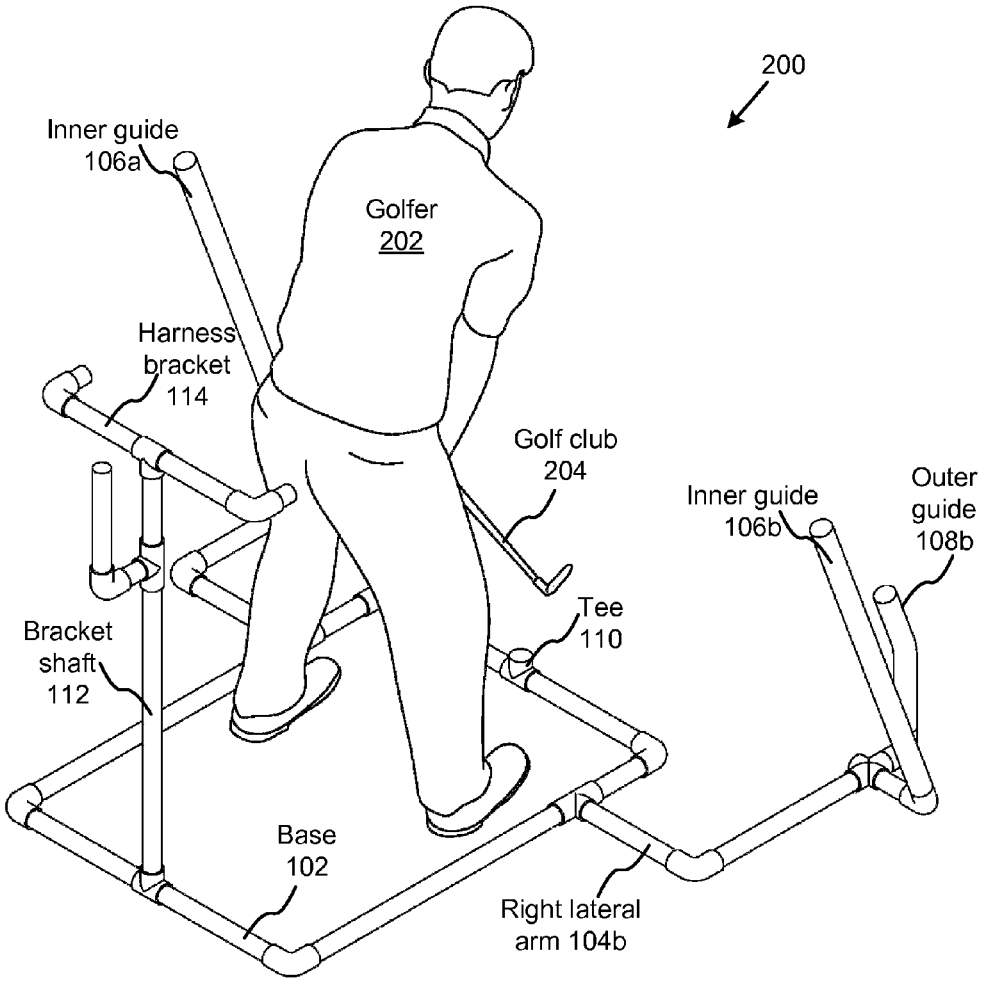
FIG. 2 is a rearward-side perspective view of a golf swing training apparatus in accordance with the present invention.

FIG. 2 is a rearward-side perspective view of a golf swing training apparatus 200 in accordance with the present invention. The golf swing training apparatus 200 comprises a base 102, a right lateral arm 104*b*, an inner guide 106*a*, an inner guide 106*b*, an outer guide 108*b*, a tee 110, a bracket shaft 112, and a harness bracket 114. A golfer 202 and a golf club 204 are also shown.

Each of the components forming the golf trainer 200 are substantially described above in relation to FIG. 1.

In the shown embodiment, the golfer 202 stands on, or in, the base 102. The golfer 202 swings a golf club 204 through the region between the inner guides 106*a-b* and the outer guides 108*a-b*. This region comprises the corridor. Should the trajectory of the golf club 204 pass outside the corridor, the golf club 204 will hit one of the guides 106-108, thus informing the golfer 202 that his simulated swing was misguided and allowing the golfer to try another swing that stays within the corridor.

Figure 3:
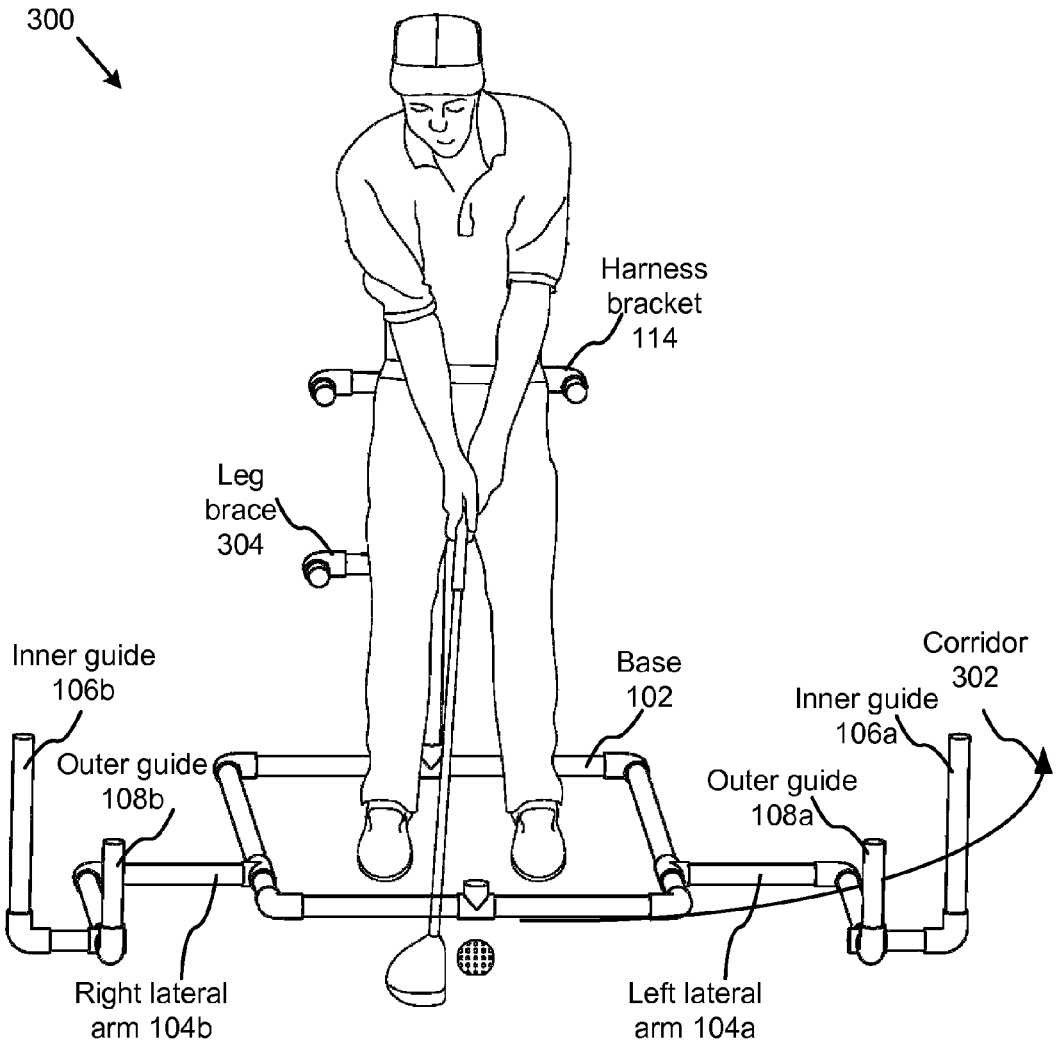
FIG. 3 is a forward elevational perspective view of another embodiment of a golf swing training apparatus in accordance with the present invention.

FIG. 3 is a forward elevational perspective view of another embodiment of a golf swing training apparatus 300 in accordance with the present invention. The golf swing training apparatus 300 comprises a base 102, a left lateral arm 104*a*, a right lateral arm 104*b*, an inner guide 106*a*, an inner guide 106*b*, an outer guide 108*a*, an outer guide 108*b*, a harness bracket 114, and a leg brace 304.

Each of the base 102, left lateral arm 104*a*, right lateral arm 104*b*, inner guide 106*a*, inner guide 106*b*, outer guide 108*a*, outer guide 108*b*, and harness bracket 114 are substantially described above in relation to FIGS. 1-2.

The leg brace 304 is affixed to the shaft 112. The leg brace 304 secures the leg of the golfer 202 during a golf swing. The leg brace 304 may comprise a harness, strip, belt or any other means known to those of skill in the art. In the shown embodiment, the leg brace juts laterally from the shaft 112 and comprises a metal or polymer hook against which the golfer 202 rests his/her leg while simulating a golf swing using the device 300.

As shown in FIG. 3, the region between the guides 106-108 defines a corridor 302 through which the golfer 202 swings his golf club 204. Should the golfer 202 swing his club 204 outside the corridor 302, the golfer 202 will hit on of the upright guides 106-108, obstructing him form completion of the improperly vectored swing.

Figure 4:
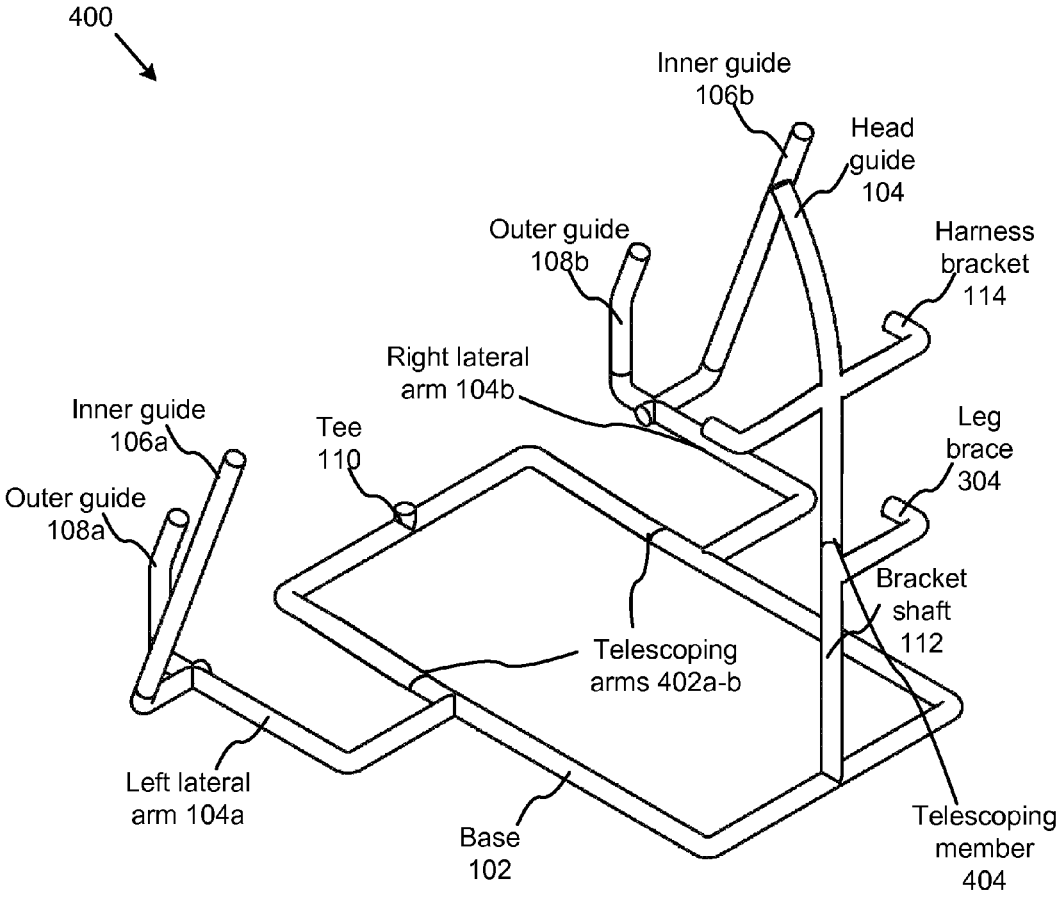
FIG. 4 is a side elevational perspective view of a golf swing training apparatus in accordance with the present invention.

FIG. 4 is a side elevational perspective view of a golf swing training apparatus in accordance with the present invention. The golf swing training apparatus 400 comprises a base 102, a left lateral arm 104*a*, a right lateral arm 104*b*, an inner guide 106*a*, an inner guide 106*b*, an outer guide 108*a*, an outer guide 108*b*, a tee 110, a bracket shaft 112, a harness bracket 114, a head guide 116, a leg brace 304, telescoping arms 402*a-b*, a telescoping member 404.

The left and right sides of base 102 are extended in the shown embodiment. In the shown embodiment, the left and right sides of the base 102 comprise telescoping arms 402*a-b* in that their length can be adjusted telescopically. Likewise, the length of the lateral arms 104*a-b* may be adjusted telescopically so that the distance of the corridor 302 from the golfer 202 is adjustable. The lateral arms 104*a-b* and the right and left sides of the base 102 may be adjusted using other means known to those of skill in the art.

The telescoping components can be locked in place with a spring pin in some embodiments.

In various embodiments, the guides 106-108 may be rotated axially around the respective arms 104*a-b* to which they affixed. In some embodiments, the guides 106-108 are flexible and/or bendable, such that the golfer 202 can form their desired shape and angle of protrusion from the lateral arms 104*a-b*.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A golf swing training device comprising:

a base comprising a plurality of tubular components, the base for engaging a ground surface, the base comprising a lower surface for engaging a ground surface and an opposing upper surface, the base defining an area on the ground upon which a golfer should stand when using the training device;

a left lateral arm affixed to the base, the left lateral arm extending from the base;

a right lateral arm affixed to the base, the right lateral arm extending from the base;

a first inner guide affixed to the left lateral arm and extending upwards above the upper surface of the base;

a first outer guide affixed to the left lateral arm and extending upwards above the upper surface of the base;

a second inner guide affixed to the right lateral arm and extending upwards above the upper surface of the base;

a second outer guide affixed to the right lateral arm and extending upwards above the upper surface of the base;

wherein the first inner guide is in closer proximity to a center of the base than the first outer guide;

wherein the second inner guide is in closer proximity to a center of the base than the second outer guide;

wherein a region between the first inner guide and the first outer guide defines a point on a linear corridor passing through a second point defined by a region between the second inner guide and the second outer guide, the corridor defining the acceptable path of a golf club being swung under simulated golf conditions.

2. The golf swing training device of claim 1, further comprising a tubular shaft affixed to the base, the shaft extending upward orthogonally from the base, the shaft affixed to a harness for securing the mid-section of a golfer's body.

3. The golf swing training device of claim 2, further comprising a leg brace jutting orthogonally from the shaft for securing the left a golfer's body.

4. The golf swing training device of claim 1, further comprising a tubular shaft affixed to the base, the shaft extending upward orthogonally from the base, the shaft affixed to a bracket, the bracket affixed to a harness for securing the mid-section of a golfer's body.

5. The golf swing training device of claim 1, wherein left lateral arm and the right lateral arm comprises telescoping components such that length of the left lateral arm and the length of the right lateral arm can be independently adjusted.

6. The golf swing training device of claim 1, wherein the base further comprises a tee for securing a golf ball.

* * * * *